United States Patent [19]

Cullen

[11] Patent Number: 4,832,390

[45] Date of Patent: May 23, 1989

[54] CLAMSHELL LOADER BUCKET WITH BROOM BRUSHES

[76] Inventor: Steven R. Cullen, 1167 Harrison, Astoria, Oreg. 97103

[21] Appl. No.: 157,585

[22] Filed: Feb. 19, 1988

[51] Int. Cl.[4] ..... B66C 3/02

[52] U.S. Cl. ..... 294/68.23; 15/4

[58] Field of Search ..... 15/4, 111, 256.5; 37/117.5, 183 R, 184, 186, 221, 232, DIG. 12; 294/51, 54.5, 59, 68.23, 86.4; 414/726, 687

[56] References Cited

U.S. PATENT DOCUMENTS

| | | | |
|---|---|---|---|
| 79,606 | 7/1868 | Smith | 37/232 X |
| 634,578 | 10/1899 | Kaucher | 15/111 |
| 4,153,287 | 5/1979 | Towsend | 294/54.5 X |
| 4,493,605 | 1/1985 | Cullen | 414/726 |

*Primary Examiner*—Johnny D. Cherry
*Assistant Examiner*—Dean Kramer
*Attorney, Agent, or Firm*—Lee R. Schermerhorn

[57] ABSTRACT

A clamshell type loader bucket has a pair of pivotal jaws with scraping edges on the bottom of the bucket for scraping material off a supporting surface. Behind the scraping edges are brushes to sweep loose material on the supporting surface into position to be forced into the bucket when the jaws are closed together.

1 Claim, 2 Drawing Sheets

CLAMSHELL LOADER BUCKET WITH BROOM BRUSHES

BACKGROUND OF THE INVENTION

This invention is an improvement on the loader bucket in U.S. Pat. No. 4,493,605 issued Jan. 15, 1985.

The loader bucket in said patent has a pair of bucket jaws pivotally mounted on vertical axes on one side of the bucket, when the bucket is in vertical position, for opening and closing movements of the jaws, the jaws having scraper edges on the bottom of the bucket to scrape material from a supporting surface when the jaws are open.

The bucket in said patent has been used for scraping light materials, such as leaves, paper, etc., causing excessive wear on the cutting edges of the scrapers and noise and damage by abrasion of the supporting surface for the material being scraped. There is a need for certain improvements for sweeping such light material into piles and collecting it in the bucket more efficiently.

SUMMARY OF THE INVENTION

The present improvements comprise the addition of brushes on the bucket jaws projecting downward below the scraper edges to sweep loose material on the supporting surface. There is a brush on each jaw mounted behind and extending along the scraper edge on the jaw, and a V-shaped brush mounted on the bucket supporting frame behind the axes of the jaws.

The addition of the brushes eliminates the problems mentioned above, while allowing large improvements in clean-up operations. Light material may be swept into piles and loaded with the same bucket more efficiently. Besides cutting down on the noise level and cost of replacement parts, it also achieves a cleaner job on uneven surfaces.

The invention will be better understood and the foregoing and additional features and advantages will become apparent from the following description of the preferred embodiment illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENT

Figure 1:
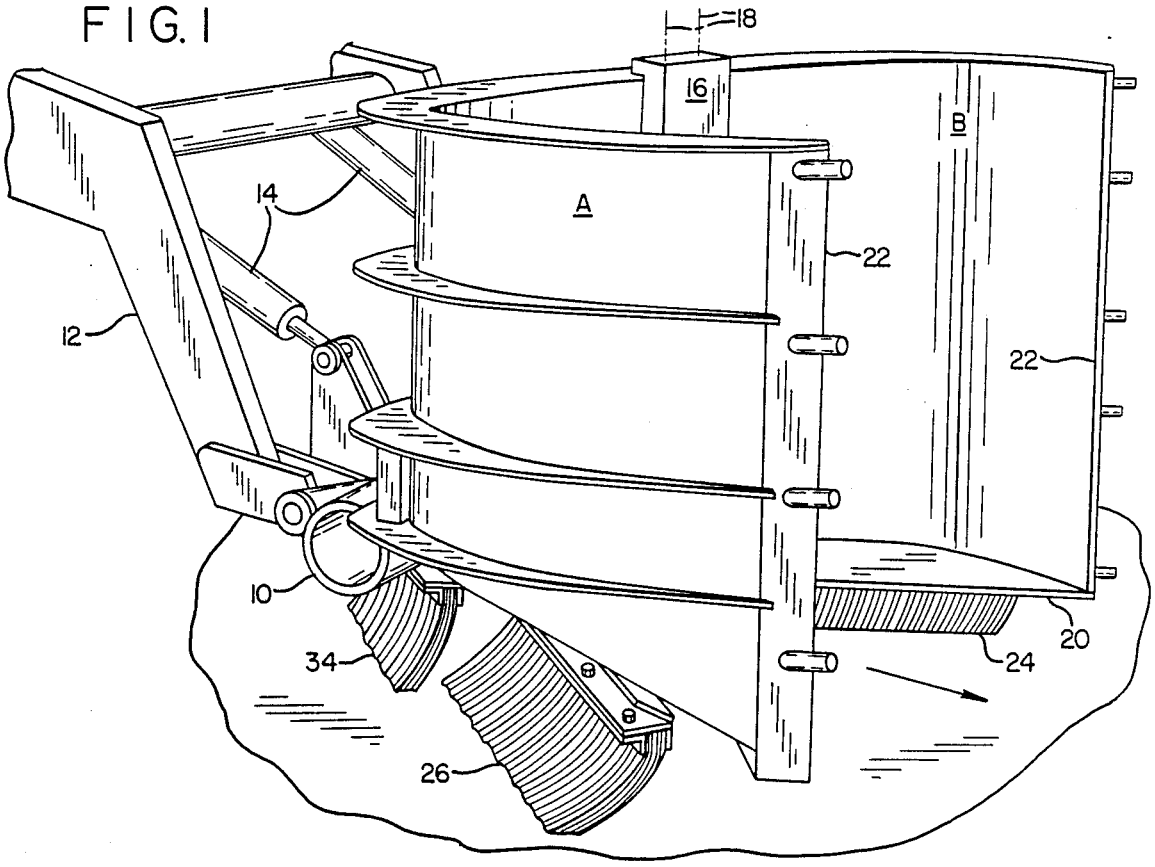
FIG. 1 is a perspective view of a loader bucket embodying the invention.
Figure 2:
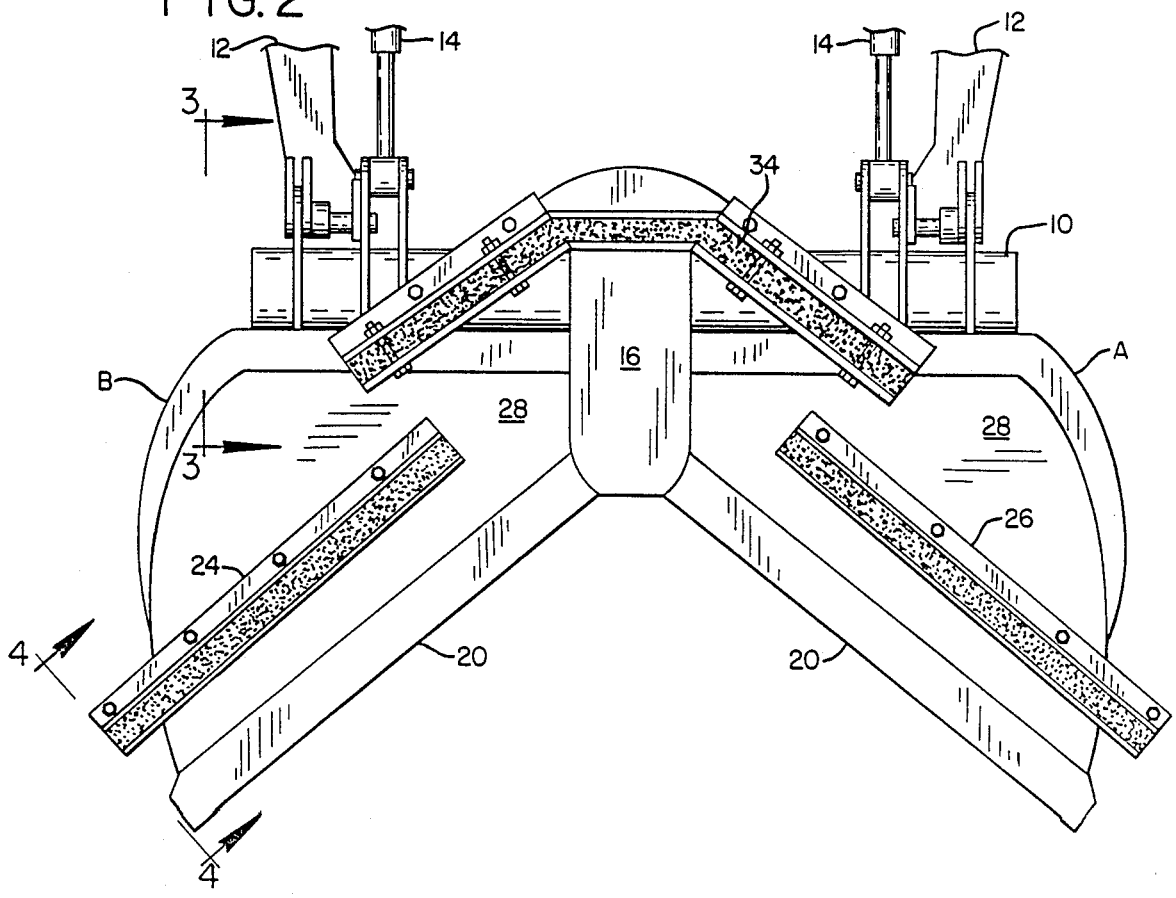
FIG. 2 is a bottom plan view.

As seen in FIGS. 1 and 2 a clamshell bucket having two jaws A and B is carried by a support frame 10 on the end of a boom 12 on the front of a tractor. The bucket is shown in vertical position with its jaws open. The bucket may be tilted forward to a horizontal position by hydraulic cylinders 14, and hydraulic cylinders on the support frame 10 operate to open and close the jaws A and B. The jaws are mounted to swing on pivotal axes 18 in arm 16 on support frame 10.

When jaws A and B are wide open as shown, scraping edges 20 on the bottoms of the jaws are disposed in a common horizontal plane for scraping a horizontal supporting surface when the tractor is driven forward, scooping the scraped material into the bottoms of the bucket jaws. Closing the bucket jaws together brings the two scraping edges 20 into contact with each other, closing the bottom of the bucket to contain the scraped material. When the jaws are closed the opposite side edges 22 meet each other to close the open side of the bucket.

Figure 4:
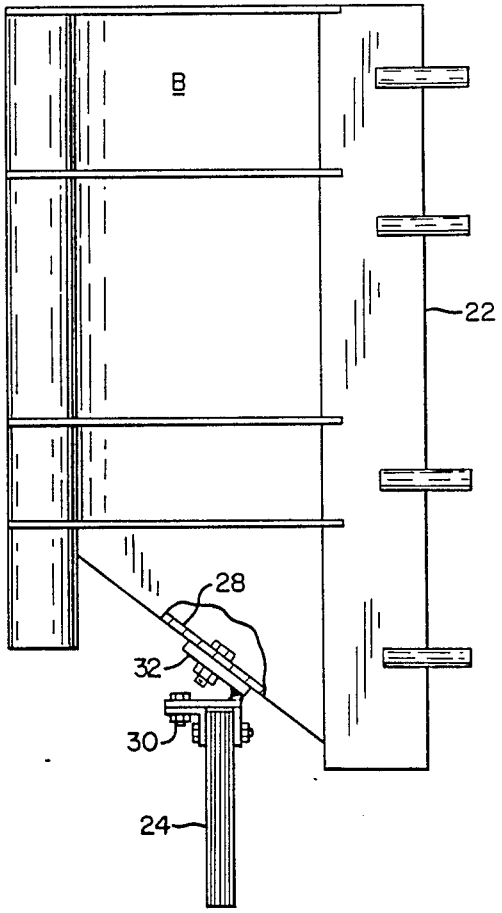
FIG. 4 is a view on the line 4—4 in FIG. 2.

Brushes 24 and 26 are mounted on the bottoms 28 of the bucket jaws, a short distance behind and parallel with scraping edges 20. The bristles in these brushes may be made of any suitable metallic or non-metallic material and are of a length to extend down, depending on model size, from 4 to 8 inches below the adjacent scraping edge 20, as seen in FIG. 4. The bristles are mounted in a holder 30 which is bolted to a bracket 32, which is in turn bolted to the bottom plate 28 of the bucket jaw. Welds may be substituted for the bolted connections if desired.

Figure 3:
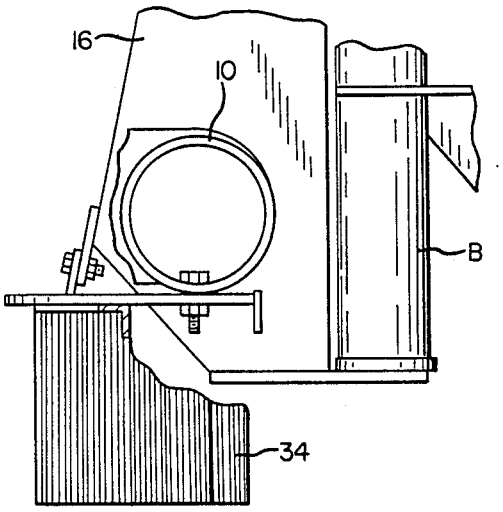
FIG. 3 is a view on the line 3—3 in FIG. 2.

A third brush 34 of V-shape is mounted on support frame 10 behind the bucket jaws to brush the open space between brushes 24 and 26 as the tractor moves forward. This brush is supported by brackets bolted to support frame 10 as shown in FIG. 3, but welds may be substituted for the bolted connections.

These three brushes do not interfere with the bucket's normal scraping operations. The bristles merely bend back behind scraping edges 20 when the latter are brought to bear on a surface to be scraped. When the loose material is swept into a pile by brushes 24, 26 and 34 the material is gathered into the bucket by scraping edges 20 when the jaws A & B are closed on opposite sides of the pile.

What is claimed is:

1. A clamshell loader bucket comprising a pair of bucket jaws pivotally mounted on vertical axes on one side of the bucket when the bucket is in vertical position, for opening and closing movements of the jaws, said jaws having scraper edges on the bottom of the bucket to scrape material from a supporting surface when the jaws are open, and brushes on said jaws projecting downward below said scraper edges to sweep loose material on said surface, there being a brush on each jaw mounted behind and extending along the scraper edge on the jaw, and including a V-shaped brush mounted on a bucket supporting frame behind said vertical axes of the jaws.

* * * * *